US006607076B1

(12) United States Patent
Smith

(10) Patent No.: US 6,607,076 B1
(45) Date of Patent: Aug. 19, 2003

(54) GOLF BAG WITH CLUB SEPARATOR

(76) Inventor: Benny E. Smith, 1664 Primrose La., Sebring, FL (US) 33872

( * ) Notice: Subject to any disclaimer, the term of this patent is extended or adjusted under 35 U.S.C. 154(b) by 0 days.

(21) Appl. No.: 10/123,464

(22) Filed: Apr. 15, 2002

(51) Int. Cl.[7] ..... A63B 55/00
(52) U.S. Cl. ..... 206/315.6; 206/315.3
(58) Field of Search ..... 206/315.3, 315.6; 211/70.2; 273/162 D

(56) References Cited

U.S. PATENT DOCUMENTS

| | | | | | |
|---|---|---|---|---|---|
| 936,698 | A | | 10/1909 | Breakspear | 206/315.6 |
| 1,434,621 | A | | 11/1922 | Marwood et al. | 206/315.6 |
| 2,551,780 | A | | 5/1951 | Wood | 206/315.6 X |
| 3,460,597 | A | | 8/1969 | Daly | 206/315.6 X |
| 3,503,518 | A | | 3/1970 | Black | 206/315.6 X |
| 3,534,795 | A | | 10/1970 | Wiedenmeier | 206/315.6 |
| 4,130,153 | A | | 12/1978 | Zopf | 206/315.6 |
| 4,136,724 | A | | 1/1979 | Leitzel | 206/315.6 |
| 4,142,563 | A | * | 3/1979 | Ackerfeldt et al. | 206/315.3 |
| 4,194,547 | A | | 3/1980 | Sidor et al. | 206/315.6 |
| 4,282,912 | A | | 8/1981 | Brown | 206/315.6 X |
| 4,779,725 | A | | 10/1988 | Gerber | 206/315.3 |
| 4,822,052 | A | * | 4/1989 | Dimmick et al. | 273/162 D |
| 4,836,565 | A | | 6/1989 | Catalo | 280/37 |
| 4,881,638 | A | * | 11/1989 | Cho | 206/315.3 |
| 4,968,037 | A | * | 11/1990 | Berry | 273/162 D |
| 5,071,147 | A | | 12/1991 | Stansbury | 206/315.6 X |
| 5,168,992 | A | | 12/1992 | Bowdy | 206/315.6 |
| 5,458,240 | A | | 10/1995 | Rich et al. | 206/315.3 |
| 5,607,053 | A | | 3/1997 | Sumiyoshi | 206/315.3 X |
| 5,671,843 | A | | 9/1997 | Sutter | 206/315.6 |
| 5,699,906 | A | | 12/1997 | Lombardo et al. | 206/315.3 |
| 5,775,513 | A | | 7/1998 | Anthony | 206/315.6 |
| 5,816,398 | A | | 10/1998 | Wang | 206/315.6 |
| 5,823,336 | A | | 10/1998 | Smith | 206/315.6 |
| 5,844,483 | A | * | 12/1998 | Boley | 206/315.3 X |
| 5,944,184 | A | | 8/1999 | Smith | 206/315.6 |
| 5,988,379 | A | * | 11/1999 | Yearous | 206/315.3 |
| 6,341,690 | B1 | * | 1/2002 | Swiatosz | 206/315.6 |
| 6,375,004 | B1 | * | 4/2002 | Tuerschmann et al. | 206/315.6 |

* cited by examiner

*Primary Examiner*—Sue A. Weaver
(74) *Attorney, Agent, or Firm*—Charles J. Prescott

(57) ABSTRACT

A golf bag for carrying a set of golf clubs including woods, irons and putter with the heads of the woods and putter positioned upward and the heads of the irons positioned downward. The golf bag includes a generally tubular golf bag case having a substantially uniform cross section along its entire length and a plurality of elongated longitudinally extending compartments formed as a unit to form an extruded plastic partition assembly having flat panels separate from the golf bag case and arranged to define an open upper end of each separate compartment. Each compartment and its associated upper opening have an individually shaped periphery sized to admit the head of only one particular iron. The golf bag has a molded bottom plate that supports the heads of the irons and the grip ends of each wood and putter and attaches to a multi-layer golf bag case. The golf bag lowers the weight distribution of the bag contents, keeps individual irons from coming into contact with one another, stops them from rattling, organizes them so as to make them easy to locate while mitigating possible damage to the shafts of clubs made with graphite shafts. Economy and practicality of manufacture are attained through plastic compression molding and extrusion-friendly design improvements.

9 Claims, 3 Drawing Sheets

GOLF BAG WITH CLUB SEPARATOR

BACKGROUND OF THE INVENTION

1. Scope of Invention

This application relates to golf bags of improved design and more particularly to golf bags that have unique molded partition features which facilitate carriage of irons with heads down, improved distribution of club weight and protection of club shafts.

2. Prior Art

Golf bags are manufactured and offered for sale in a multitude of forms from the lightweight, subset cloth bags (See U.S. Pat. No. 5,238,109) to the heavy weight, multi-compartment bags (See U.S. Pat. No. 5,222,598).

Many innovations have been applied in design and construction of golf bags to mitigate problems with prior construction or provide special features. For example, one type innovation concerns protection of the heads of wood clubs (See U.S. Pat. Nos. 1,876,134 & 5,004,345).

While the majority of golf bags carry a full set of clubs loosely and unseparated, another type innovation concerns separating clubs individually or ill groups by providing longitudinal separators therein (See U.S. Pat. Nos. 4,311,178, 5,148,915, 5,135,107, 5,279,414, 5,465,839 & 5,544,743).

A further type innovation concerns modification of the top portion or throat of the golf bags to hold club heads individually separated or separated in small groups (See U.S. Pat. Nos. 4,596,328, 4,600,100, 4,667,820, 4,995,510 & 5,458,240).

Yet another type Innovation to separate and organize clubs involves providing a special type throat on the bag plus contoured seats or recesses in the bottom of the bag (See U.S. Pat. No. 5,029,703).

Still another type innovation to separate and organize clubs involves providing grouped ledges and brackets upstanding from the bag throat (See U.S. Pat. No. 3,503,518).

All of the innovations discussed above relate to conventional golf bags, into which clubs are inserted, shaft first, with heads up. It has also been disclosed to carry the irons of a golf club set with heads down in an unconventional, rectangular case (See U.S. Pat. No. 5,168,992).

In addition to club organization problems associated with golf bags, the development of graphite shaft clubs has created yet another problem in carrying golf clubs in even improved type golf bags, i.e., damage to the graphite shafts by "nicking" (See U.S. Pat. No. 5,393,581).

A golf club carrier invented by Leitzel described in U.S. Pat. No. 4,136,724 teaches a pleated, resilient plastic irons separator for insertion of the irons clubs between adjacent folds into an upright orientation with club heads down. Although club separation is accomplished, any iron will fit between any of the pleats so that club identification is lacking.

A very recent U.S. Pat. No. 5,607,053 teaches a golf club storing device invented by Sumiyoshi which stores all of the golf clubs, irons and woods, in the heads down position into elongated flexible tubular sacks. Again, no club identification is afforded by this device.

In spite of the numerous innovations that have been made and applied to golf bags, the vast majority of known golf bags continue to present users with problems, e.g., the top-heavy nature of the bags because the heaviest part of the clubs, namely the heads, are carried at the top of the bags, club damage and ease of identification. My previous U.S. Pat. Nos. 5,944,184 and 5,822,336 address these existing problems. However, the present invention also addresses other manufacturing and economic problems yet remaining by providing golfers with an unconventional and remarkably improved type of golf bag of a more practical, manufacturable design.

It is therefore an object of this invention to provide a golf bag which keeps individual irons from coming into contact with one another, to stop them from rattling and to organize them so as to make them easy to locate.

It is another object of this invention to mitigate damage to shafts of clubs made with graphite or delicate shafts.

A further object of this invention is to provide adequate space for the head of the putter and woods so it will not touch other clubs even if the putter has a wide variation of sizes and shapes.

It is yet another object of this invention to accommodate a large range in shapes and sizes of woods or drivers carried in a set of clubs and to hold their heads upwardly in generally fixed position.

Still another object of this invention to carry all irons with heads down at the bottom of the improved golf bag lowering weight distribution in the golf bag and thereby mitigating tendency to tip over.

Yet another object of this invention is to enable this new golf bag of the present invention to have a size and elongated shape typical of conventional golf bags.

It is still another object of this invention to have the space tolerance to accept and hold all irons of most commercially available golf club sets.

A yet further object of this invention is to satisfy the above objects with an improved, more economical and easy to manufacture extruded plastic design.

In accordance with these and other objects which will become apparent hereinafter, the instant invention will now be described with reference to the accompanying drawings.

BRIEF SUMMARY OF THE INVENTION

The objects are accomplished in accordance with the invention by the provision of an improved golf bag for carrying a set of golf clubs including woods, irons and putter with the heads of the woods and putter positioned upward and the heads of the irons positioned downward.

Each partition is formed of substantially straight and flat longitudinal extending panels or partitions within a generally circular or oval-shaped tubular body. The preferred embodiment is formed as a plastic extrusion producing the desired cross sectional configuration and compartment size and arrangement.

The new golf bags of the invention eliminate several of the annoyances associated with the use of conventional golf bags, i.e., rattling of the clubs and haphazard, moveable carriage of clubs making them hard to quickly identify and be easily removable from the conventional bags. Thus, in the new golf bags, all clubs are held in an steady manner and organized position, particularly the irons which are held with shafts up and against the bag perimeter making each iron club easy to quickly identify and easily remove without interference from other clubs in the bag.

This invention is therefore directed to a golf bag for carrying a set of golf clubs including woods, irons and putter with the heads of the woods and putter positioned upward and the heads of the irons positioned downward. The golf bag includes a generally tubular golf bag case having a substantially uniform cross section along its entire length and a plurality of elongated longitudinally extending compartments formed as an extruded plastic partition assembly having flat panels arranged to define an open upper end of each separate compartment. Each compartment and its associated upper opening have an individually shaped periphery sized to admit the head of only one particular iron. The golf bag has a molded bottom plate that supports the heads of the irons and the grip ends of each wood and putter and attaches to a multi-layer golf bag case. The golf bag lowers the weight distribution of the bag contents, keeps individual irons from coming into contact with one another, stops them from rattling, organizes them so as to make them easy to locate while mitigating possible damage to the shafts of clubs made with graphite shafts. Economy and practicality of manufacture are attained through plastic extrusion-friendly design improvements.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DETAILED DESCRIPTION OF THE INVENTION

Figure 1:
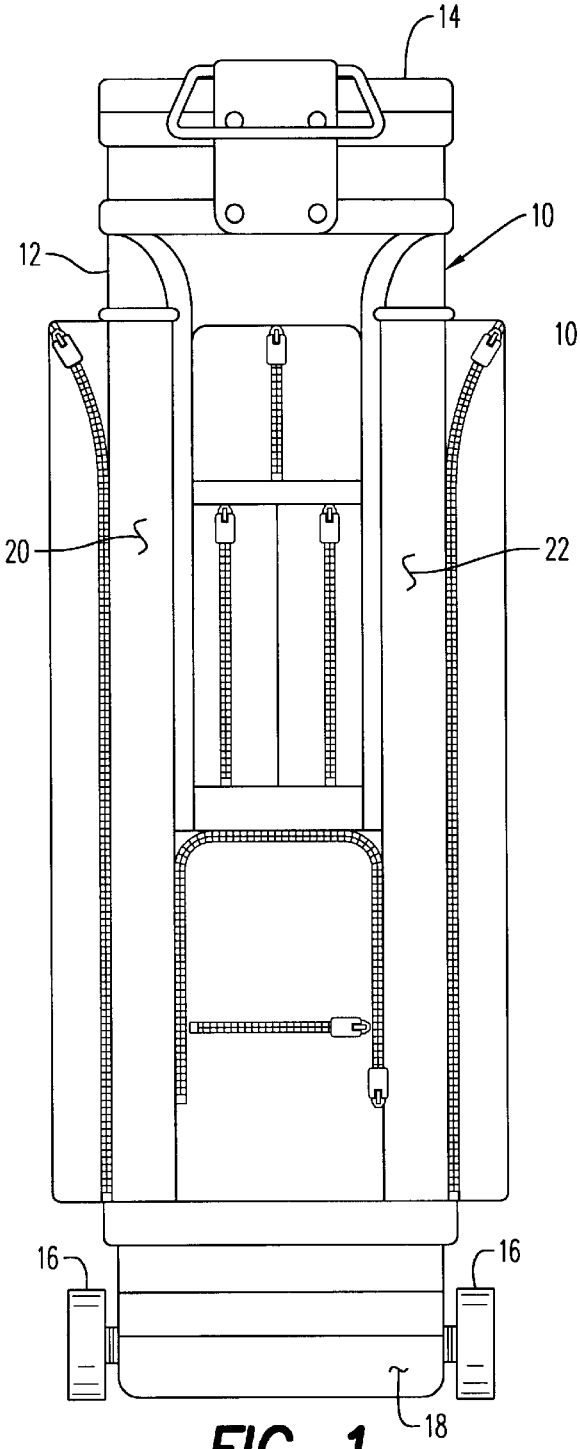
FIG. 1 is a front elevation view of the invention.
Figure 2:
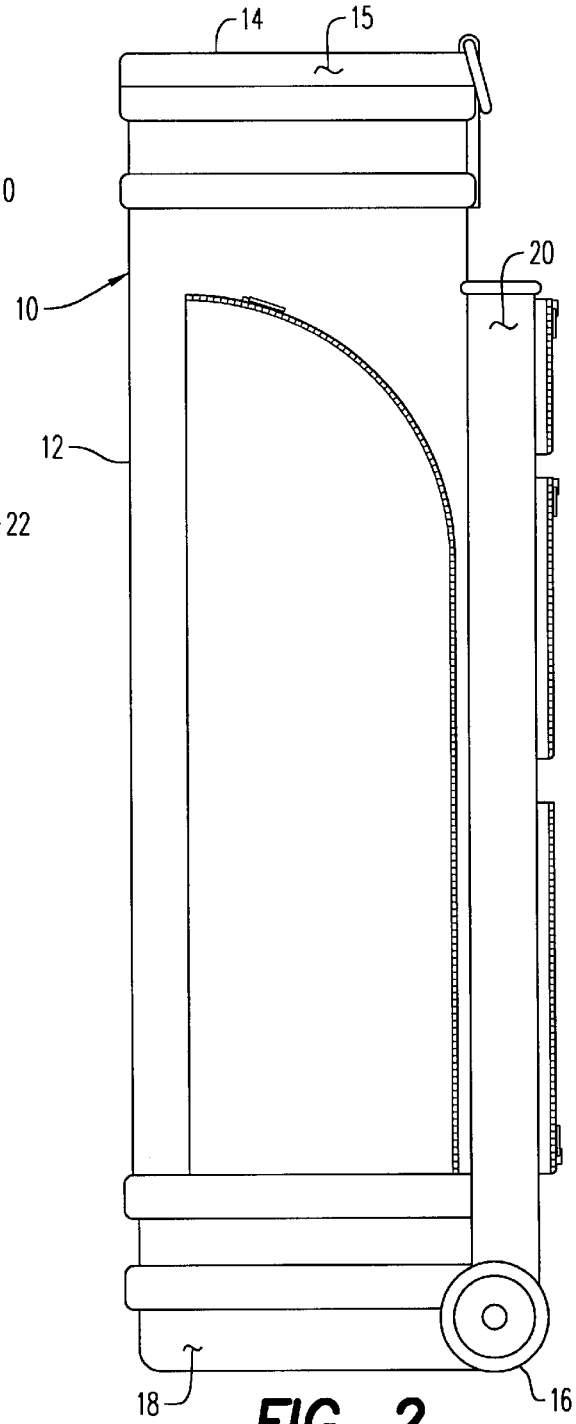
FIG. 2 is a side elevation view of FIG. 1.
Figure 3:
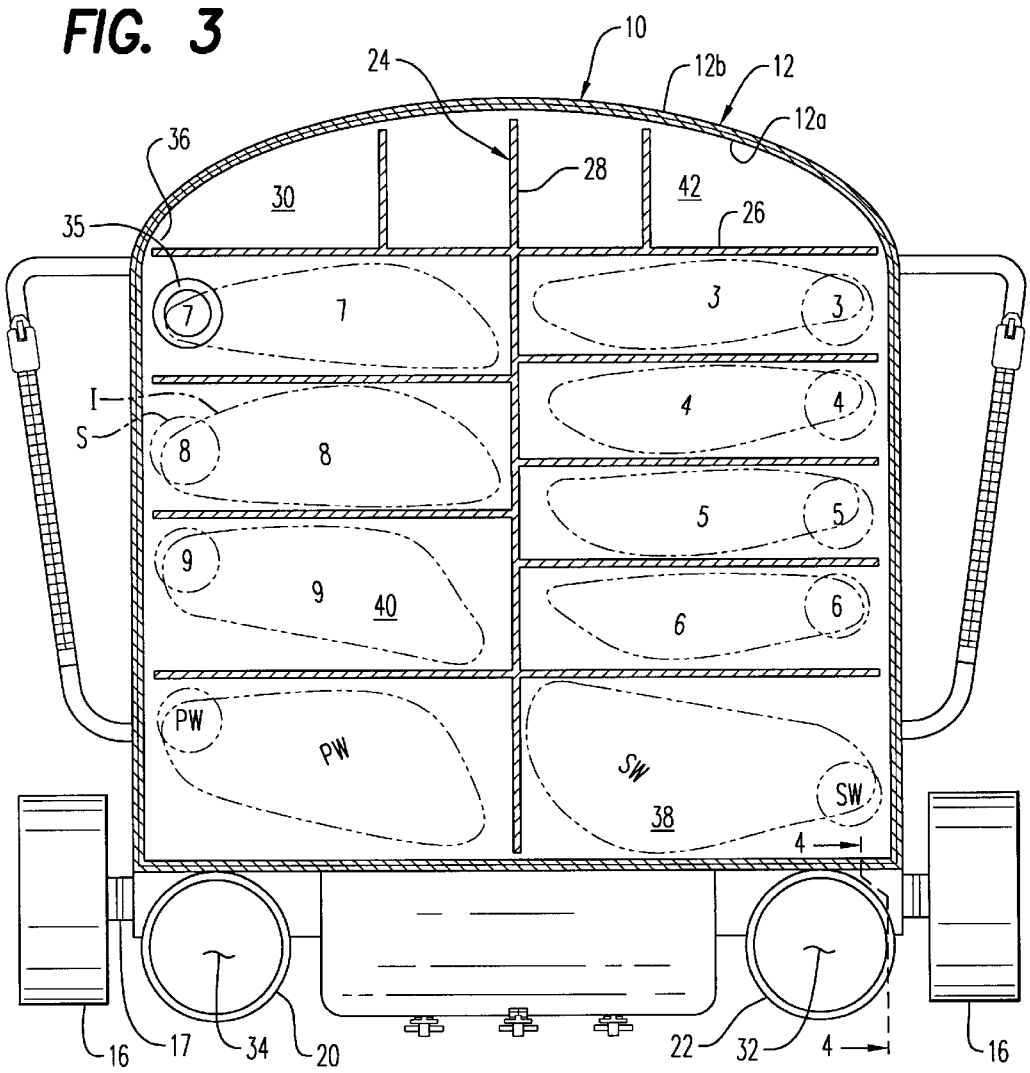
FIG. 3 is a top plan view of FIG. 1 with each iron club head and shaft shown in phantom.
Figure 5:
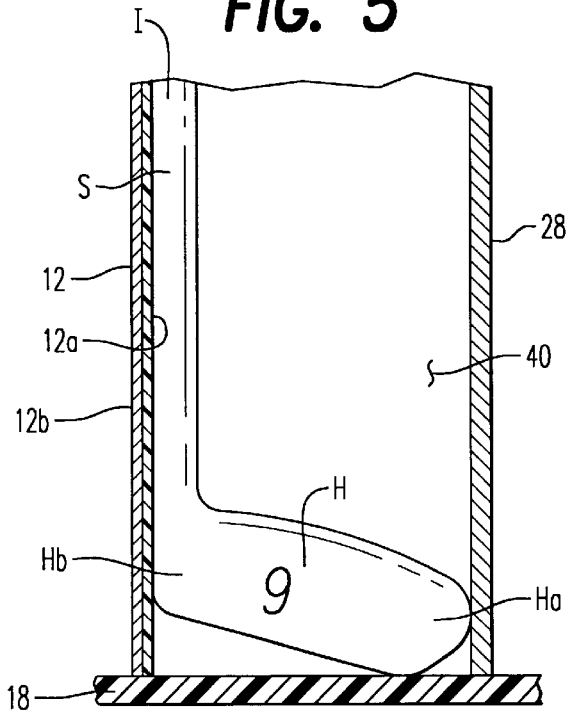
FIG. 5 is a fragmentary section view showing the manner in which downwardly oriented iron club heads are held in the invention.

Referring now to the drawings, and particularly to FIGS. 1 to 3, a golf bag 10 is constructed in accordance with the invention for carrying a set of golf clubs including woods (not shown), irons I, and putters (not shown), each having a shaft S and a head H with a toe Ha and a heel Hb thereof. The heads of the woods and putters (not shown) are positioned upwardly, while the heads H of the irons I are positioned downwardly to rest atop the bottom 18 of the golf bag 10 as best seen in FIG. 5 described in more detail herebelow.

The golf bag 10 includes a straight cylindrical multi-layer golf bag case 12 elongated along a longitudinal axis and defining an open upper perimeter 14 formed by a molded bezel 15, the closed molded bottom 18 and a flexible central outer portion which may be of a conventional nature to define closeable zippered pouches as desired. The golf bag case 12 is formed of an inner plastic molded extruded member 12*a* and a flexible outer layer 12*b* formed of vinyl, NAUGAHYDE, leather and the like which is attached thereto described herebelow.

The golf bag 10 further includes a separate elongated straight inner partition member 24 formed of plastic by compression molding. The partition member 24 includes a flat central panel 28 and flat side panels or partitions 26 which, in combination with the golf bag case 12, define a plurality of wood club compartments 30 and irons compartments 40. One or more putters are carried heads up, with the shafts slidably fitting into the interiors 34 and 32, of separate elongated tubular compartments 20 and 22, respectively, which are attached to the outer surface of the golf bag case 12. Note that the distal edges 36 of each of the flat panels 34 are held in spaced apart or snug-fitting engagement with respect to the inner surface of the inner case member 12*a* to better facilitate manufacture of each by plastic extrusion or compression molding. The partition member 24 is slidably inserted into the golf bag case 12 after these components are individually manufactured.

The number of compartments as at 38 and 40 total nine to accommodate a standard set of irons consisting of irons 3 to 9, a pitching wedge (P.W.) and a sand wedge (S.W.). In use of the golf bag 10, the heads of the irons I are inserted downwardly through the open upper end of a respective compartment as at 38 and 40 and lowered thereto. The individual irons I are kept from coming into contact with one another and are prevented from rattling by gravity action as illustrated in FIGS. 3 and 5 with each toe Ha against central partition 28 and/or each club head heel Hb and shaft S resting against the inner surface of the inner club bag member 12*a*. Moreover, since a separate compartment is provided for each irons club 1, they are organized, making them easy to locate or alerting the golfer to a missing club, there being space and provision to hold all the irons of most commercially available golf club sets. To aid in iron club identification, numbers 35 may be adhesively attached to the ends of the shafts as shown in FIG. 3.

Further, the separate compartment arrangement mitigates the possibility of damage to shafts of clubs made with delicate graphite and, since all irons I, as seen in FIG. 5, are carried with heads H down atop the inner surface 18*a* of bottom 18 of the golf bag 10, weight distribution is also improved (lowered) in the golf bag 10, thereby mitigating the tendency of the bag to tip over. Moreover, the new golf bag 10 provides adequate space for the head H of each putter in separate compartments 20 and 22 so that each putter cannot touch other clubs. Alternately, one of the woods may be placed into one of the tubular compartments 20 or 22, and, in combination with placing the other two woods into corner compartments 30 and 42 in FIG. 3, no club head damage by contact with other clubs is possible. This obviates the need for protective wood head covers. Additionally, the golf bag 10 can be made in the a somewhat tubular shape and size, e.g., about 9 inch across, of conventional golf bags so they can be carried in standard racks of golf carts.

Figure 4:
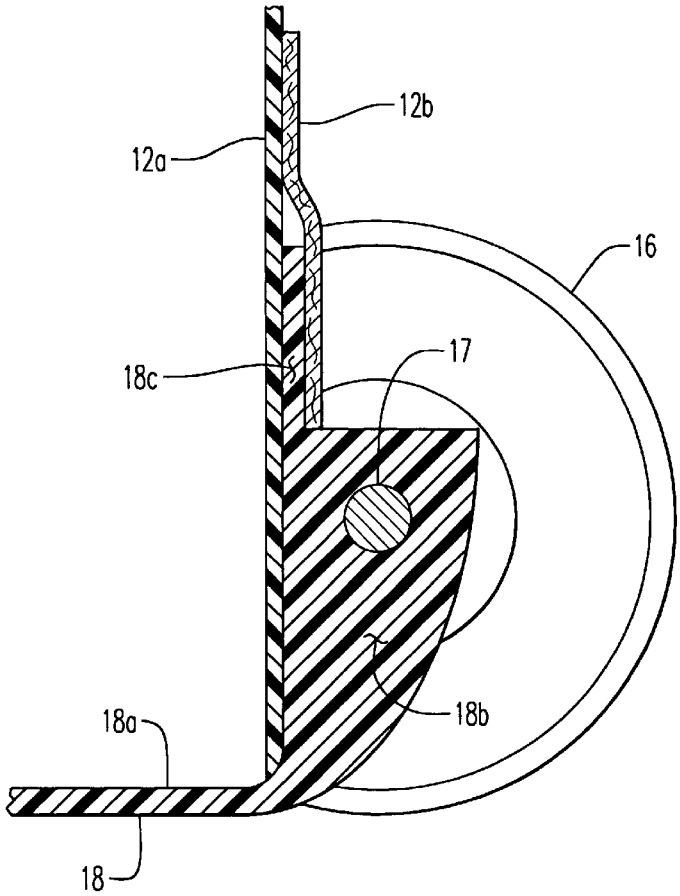
FIG. 4 is a section view in the direction of arrows 4—4 in FIG. 3.

As best seen in FIGS. 3 and 4, two spaced wheels 16 mounted on a transverse axle shaft 17 are provided to facilitate the rolling transport of the golf bag 10 by pulling or pushing an elongated diagonally extending handle (not shown).

The molded plastic bottom 18 includes an enlarged outer section 18*b* which support the axle 17. An upwardly extending flange 18*c* forms an upper perimeter whereby the inner molded golf bag member 12*a* fits snugly inside of the perimeter flange 18*c* and is secured thereto by conventional means while the decorative flexible outer golf bag member 12*b* snugly the outer surface of the upper perimeter flange 18*c*. The inner and outer member 12*a* and 12*b* are then brought together just above the flange 18*c* and held as show by conventional stitching, gluing, mechanical means and the like.

While the instant invention has been shown and described herein in what are conceived to the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A golf bag for carrying a set of golf clubs including woods, irons and putter with the heads of the woods and putter positioned upward and the heads of the irons positioned downward, comprising:

a generally tubular elongated golf bag case having a substantially uniform cross section along an entire length thereof;

an inner partition member formed as a single unit and having a plurality of elongated longitudinally extending compartments positioned within said golf bag case and being formed by a plurality of interconnected flat panels which define an open upper end of each compartment;

a distal longitudinally extending edge of each said flat panel extending outward toward or snug engagement with, but unconnected to said golf bag case whereby said inner partition member is slidably insertable into said golf bag case;

each said compartment and its associated upper opening have an individually shaped periphery sized to admit the head of only one particular iron;

a bottom plate attached to a lower end of said golf bag case and said flat panels that supports the heads of the irons and the grip ends of each wood and putter;

whereby weight distribution of said bag and its golf club contents is lowered and individual irons are kept from coming into contact with one another.

2. A golf bag as set forth in claim 1, further comprising:

a tubular club holder positioned adjacent an outer surface of, and generally coextensive with, said golf bag case and sized to receive and support a shaft of a putter or a wood whereby no contact with other clubs in said golf bag is possible.

3. A golf bag as set forth in claim 1, further comprising:

numbered adhesive labels each sized for attachment onto the distal ends of the correspondingly numbered irons shafts whereby the number of each iron is more easily identified when stored in said golf bag.

4. A golf bag for carrying a set of golf clubs including woods, irons and putter with the heads of the woods and putter positioned upward and the heads of the irons positioned downward, comprising:

a generally tubular elongated golf bag case having a substantially uniform cross section along an entire length thereof;

said golf bag case having an elongated extruded inner member and a decorative flexible outer member coextensive with and attached against an outer surface of said inner member;

an inner partition member formed as a single unit having a plurality of elongated longitudinally extending compartments positioned within said golf bag case and being formed by a plurality of interconnected flat panels which define an open upper end of each compartment;

a distal longitudinally extending edge of each said flat panel extending outward toward or snug engagement with, but unconnected to said golf bag case whereby said inner partition member is slidably insertable into said golf bag case;

each said compartment and its associated upper opening have an individually shaped periphery sized to admit the head of only one particular iron;

a bottom plate attached to a lower end of said golf bag case and said flat panels that supports the heads of the irons and the grip ends of each wood and putter;

whereby weight distribution of said bag and its golf club contents is lowered and individual irons are kept from coming into contact with one another.

5. A golf bag as set forth in claim 4, further comprising:

a tubular club holder positioned adjacent an outer surface of, and generally coextensive with, said golf bag case and sized to receive and support a shaft of a putter or a wood whereby no contact with other clubs in said golf bag is possible.

6. A golf bag as set forth in claim 4, further comprising:

numbered adhesive labels each sized for attachment onto the distal ends of the correspondingly numbered irons shafts whereby the number of each iron is more easily identified when stored in said golf bag.

7. A golf bag for carrying a set of golf clubs including woods, irons and putter with the heads of the woods and putter positioned upward and the heads of the irons positioned downward, comprising:

a generally tubular elongated golf bag case having a substantially uniform cross section along an entire length thereof;

said golf bag case having an elongated extruded inner member and a decorative flexible outer member coextensive with and attached against an outer surface of said inner member;

a partition member formed as a unit and defining a plurality of elongated longitudinally extending compartments positioned within said golf bag case, each said compartment being formed by a plurality of interconnected flat panels and said inner member which define an open upper end of each compartment;

a distal longitudinally extending edge of each said flat panel extending outward toward or snug engagement with, but unconnected to said golf bag case whereby said inner partition member is slidably insertable into said golf bag case;

each said compartment and its associated upper opening having an individually shaped periphery sized to admit the head of only one particular iron;

a bottom plate attached to a lower end of said golf bag case and said flat panels that supports the heads of the irons and the grip ends of each wood and putter;

whereby weight distribution of said bag and its golf club contents is lowered and individual irons are kept from coming into contact with one another.

8. A golf bag as set forth in claim 7, further comprising:

a tubular club holder positioned adjacent an outer surface of, and generally coextensive with, said golf bag case and sized to receive and support a shaft of a putter or a wood whereby no contact with other clubs in said golf bag is possible.

9. A golf bag as set forth in claim 7, further comprising:

numbered adhesive labels each sized for attachment onto the distal ends of the correspondingly numbered irons shafts whereby the number of each iron is more easily identified when stored in said golf bag.

* * * * *